US005538153A

United States Patent [19]

Marovskis et al.

[11] Patent Number: 5,538,153

[45] Date of Patent: Jul. 23, 1996

[54] FOLDING CRATE FOR HOLDING PACKAGES

[75] Inventors: Harijs B. Marovskis, Plymouth; Brian N. Lipsius, Chanhassen, both of Minn.

[73] Assignee: Tetra Laval Holdings & Finance SA, Pully, Switzerland

[21] Appl. No.: 176,575

[22] Filed: Dec. 30, 1993

[51] Int. Cl.[6] ..... B65D 21/02

[52] U.S. Cl. ..... 220/6; 220/7; 206/509; 206/511; 206/512

[58] Field of Search ..... 220/6, 7; 206/509, 206/511, 512

[56] References Cited

U.S. PATENT DOCUMENTS

| | | | |
|---|---|---|---|
| 3,424,365 | 10/1967 | Venturi | 229/30 |
| 4,044,910 | 8/1977 | Box | 220/7 |
| 4,320,845 | 3/1982 | Waller | 220/6 |
| 4,591,065 | 5/1986 | Foy | 220/7 |
| 4,674,647 | 6/1987 | Gyenge et al. | 220/6 |
| 4,693,386 | 9/1987 | Hughes et al. | 220/1.5 |
| 4,735,331 | 4/1988 | Kennan et al. | 220/6 |
| 4,775,068 | 10/1988 | Reiland et al. | 220/6 |

*Primary Examiner*—Joseph M. Moy

*Attorney, Agent, or Firm*—Burns, Doane, Swecker & Mathis

[57] ABSTRACT

A folding crate for holding packages includes a base having a substantially planar support surface for supporting packages and a plurality of side walls positioned along the sides of the base. A hinge pin member having a generally oval or elliptical cross-sectional shape is located along each side of the base. The hinge pin member is oriented in such a manner that the major axis of the cross-section is positioned substantially perpendicular to the plane of the support surface while the minor axis of the cross-section is located substantially parallel to the plane of the support surface. The bottom end of each of the side walls is provided with a knuckle for mounting the side walls on the base and a through hole is formed in each knuckle for loosely receiving one of the hinge pin members. The knuckle on each side wall also includes a slotted opening for allowing the side wall to be mounted on the hinge pin member. The width of the slotted opening is less than the largest dimension of the cross-sectional shape of the hinge pin member so that the side wall is inhibited from becoming detached from the hinge pin member when the side wall is vertically oriented. In addition, one of the side walls can be constructed such that its center of gravity is located inwardly of the longitudinal axis of the respective hinge pin member when the one side wall is in the upright vertical position.

21 Claims, 6 Drawing Sheets

FIG. 2
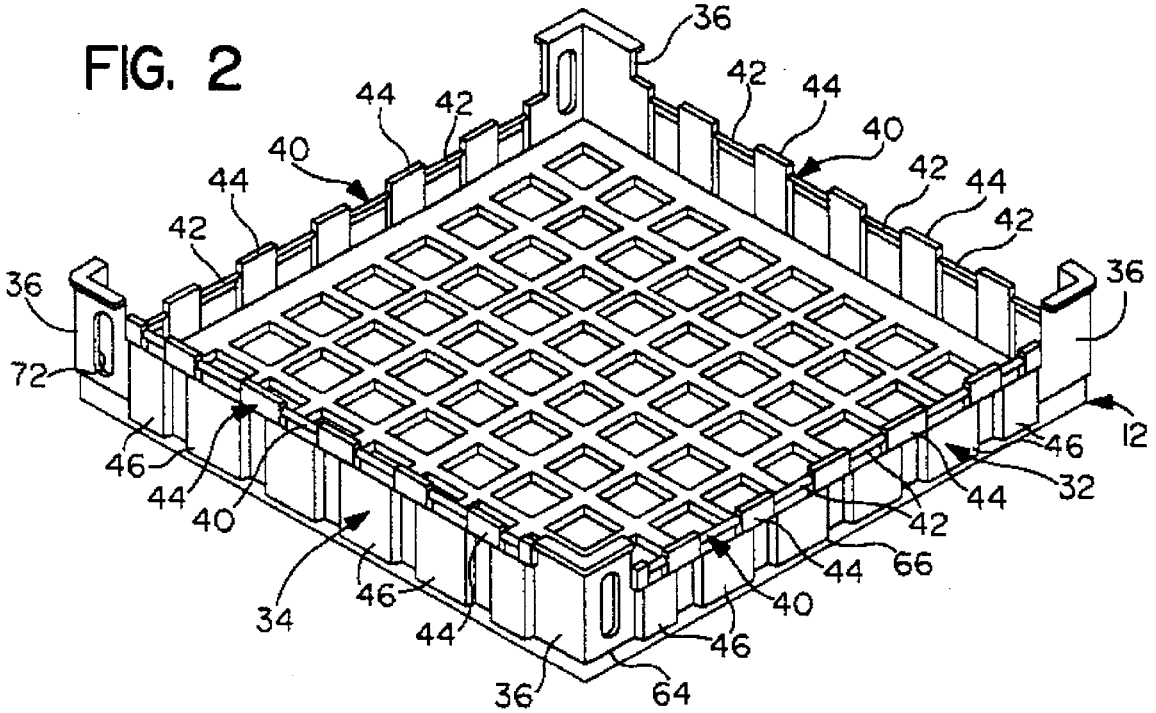
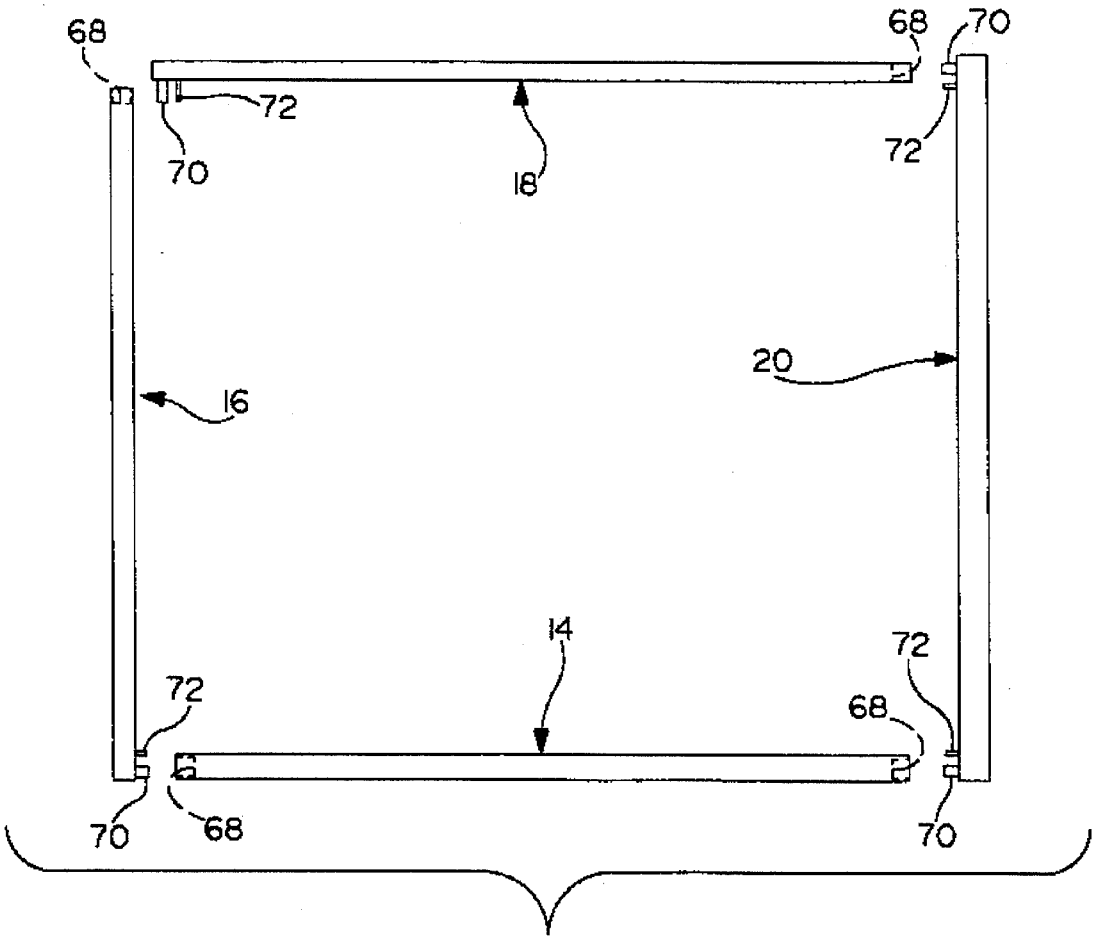
FIG. 3

FOLDING CRATE FOR HOLDING PACKAGES

FIELD OF THE INVENTION

The present invention pertains to a crate for holding packages. More particularly, the present invention relates to a foldable crate for holding packages such as gable-top type packages.

BACKGROUND OF THE INVENTION

Packages that contain various types of products such as, for example, liquids, are usually transported by placing the packages in a shipping crate. Typically, the crates are dimensioned to receive and hold a plurality of such packages so that numerous packages can be easily shipped.

Crates used for the foregoing purpose are oftentimes constructed as a one-piece rigid unit. Although such crates serve the intended purpose of allowing the crates to be more easily transported, they do suffer from certain disadvantages and drawbacks. For example, before the packages are placed in the crate for shipment to the distributors, the crates must be stored in some area of the packaging facility. Since the crates cannot be reduced in size due to their rigid construction, a large storage area is typically required to store the crates. From a manufacturing standpoint, it may not be cost effective to utilize a large portion of the packaging plant for storing the empty crates.

In addition, after the packages have been removed from the crates, the empty crates must be transported back to the distributor or to the packaging plant. Once again, the rigid construction of the crates requires a large amount of storage space for transporting the empty crates.

Further, the rigid nature of the crates makes them particularly attractive for use in constructing rudimentary tables, shelving and the like. Thus, it has been found that the rigid crates are frequently stolen for use as a cheap furniture component.

In view of the foregoing, a need exists for a crate for holding packages that is not susceptible to the same disadvantages and drawbacks noted above.

OBJECTS AND SUMMARY OF THE INVENTION

The present invention provides a crate for holding packages that is well suited for addressing at least the foregoing disadvantages and drawbacks associated with other known crates. The crate according to the present invention is foldable, thereby reducing the amount of storage space required to store and transport the crates. In addition, because the crate is foldable, it is not as attractive to would-be thieves seeking to use the crate as a supporting component of a shelving system.

In accordance with one aspect of the present invention, a folding crate for holding packages includes a base having a substantially planar support surface and four sides walls which are each located along one of the sides of the base. Each side of the base is provided with a hinge pin member having a longitudinal axis that is vertically spaced from the plane of the support surface. Each of the pin members is generally oval or elliptical in cross-section with the minor axis of the cross-section being positioned substantially parallel to the plane of the support surface and the major axis of the cross-section being positioned substantially perpendicular to the plane of the support surface. Each of the side walls has at least one knuckle extending from the lower end. The knuckle on each side wall has a substantially circular through hole which loosely receives the hinge pin member so that the side wall can be pivoted from an upright position to an inwardly folded position. The knuckle on each side wall is provided with a slotted opening which extends through a wall of the knuckle and into the through hole for allowing the side wall to be mounted on the respective hinge pin member. The slotted opening possesses a width that is less than the dimension of the cross-section of the hinge pin member as measured along the major axis. In addition, at least one of the side walls is provided with a protuberance on the outer surface that extends outwardly away from surrounding areas of the side wall. The protuberance is hollow and has an open lower end for receiving a tool for use in moving the crate and a plurality of other crates stacked thereon.

Another aspect of the present invention involves a folding crate for holding packages that includes a base having a substantially planar support surface for supporting packages and a plurality of sides walls which are each provided with a knuckle at the bottom end. The base possesses a plurality of sides which are each provided with a hinge pin member. The hinge pin member possesses a cross-sectional shape in which a first dimension of the cross-sectional shape along a line extending substantially perpendicular to the plane of the support surface is greater than a second dimension of the cross-sectioned shape along a line extending substantially parallel to the plane of the support surface. The knuckle on each of these side walls is provided with a through hole which loosely receives one of the hinge pin members for allowing the side wall to be moved from an upright vertical position to an inwardly folded position. The knuckle on each of these side walls includes a slotted opening which extends through a wall of the knuckle and which communicates with the through hole in the knuckle to allow the side wall to be mounted on the hinge pin member. The slotted opening possesses a width that is less than the first dimension of the cross-sectional shape of the hinge pin member.

In accordance with another aspect of the present invention, a folding crate for holding packages includes a base having a substantially planar support surface for supporting packages and a plurality of sides walls which are each located on one of the sides of the base. Each side of the base is provided with a hinge pin member which possesses a longitudinal axis that is vertically spaced above the plane of the support surface. The longitudinal axis of each of the hinge pin members is vertically spaced from the plane of the support surface by a different distance. Each of the side walls is provided with a knuckle for mounting the side wall on a respective one of the hinge pin members. Each of the hinge pin members is loosely received in a through hole that is provided in the knuckle of a respective side wall so that each side wall can be moved from an upright vertical position to an inwardly folded horizontal position. One of the side walls is constructed such that a center of gravity of the one side wall is located inwardly of the longitudinal axis of the respective hinge pin member when the one side wall is in the upright vertical position.

A further aspect of the present invention involves a folding crate for holding packages that includes a base having a substantially planar support surface for supporting packages and a plurality of side walls mounted on the base. At least one of the side walls is provided with a protuberance on the outer surface that extends outwardly away from surrounding areas of the side wall. The protuberance has a front surface and side surfaces which define a hollow area, and a lower end of the protuberance is open to the hollow area to allow a tool to be inserted through the open end and into the hollow area for use in moving the crate and a plurality of other crates stacked thereon.

BRIEF DESCRIPTION OF THE DRAWING FIGURES

A preferred embodiment of the present invention will be described in greater detail with reference to the accompanying drawing figures in which like elements are identified by like reference numerals and wherein:

FIG. 2 is a top perspective view of the base which forms a part of the folding crate of the present invention;

FIG. 3 is a top view of the side walls of the folding crate showing the interengaging elements on the side walls that help maintain the side walls in a vertical orientation;

Figure 8:
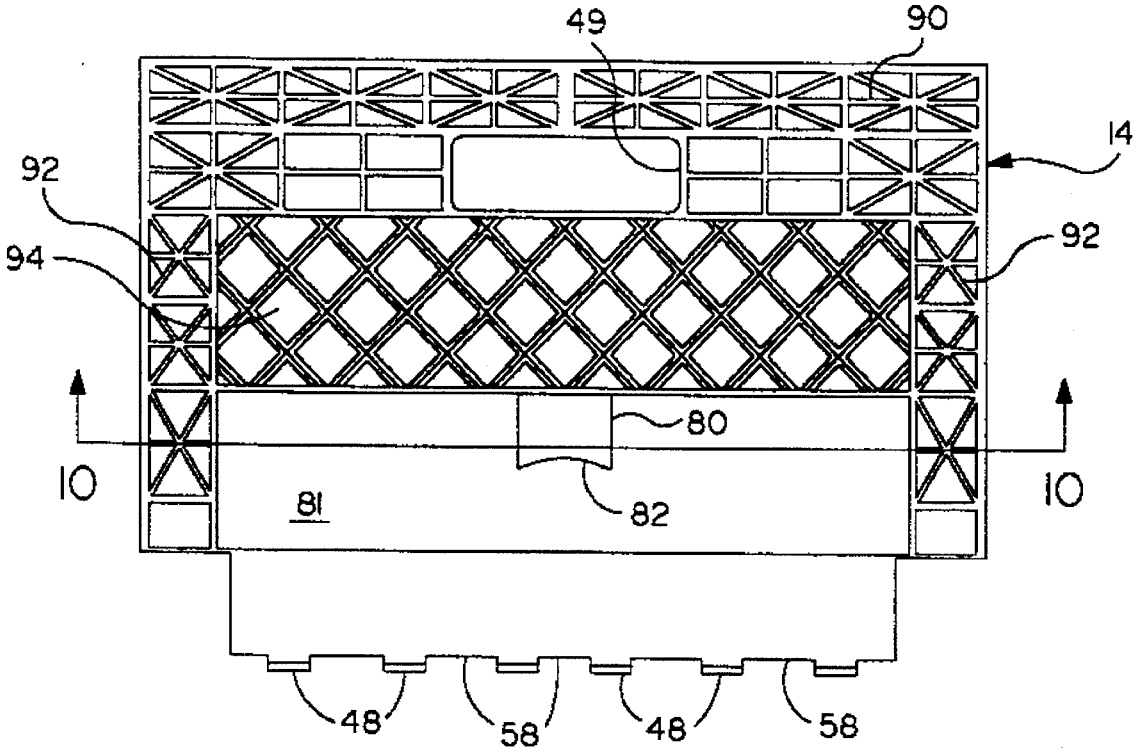
FIG. 8 is a front view of one of the side walls that is mounted on the base of the crate.
Figure 9:
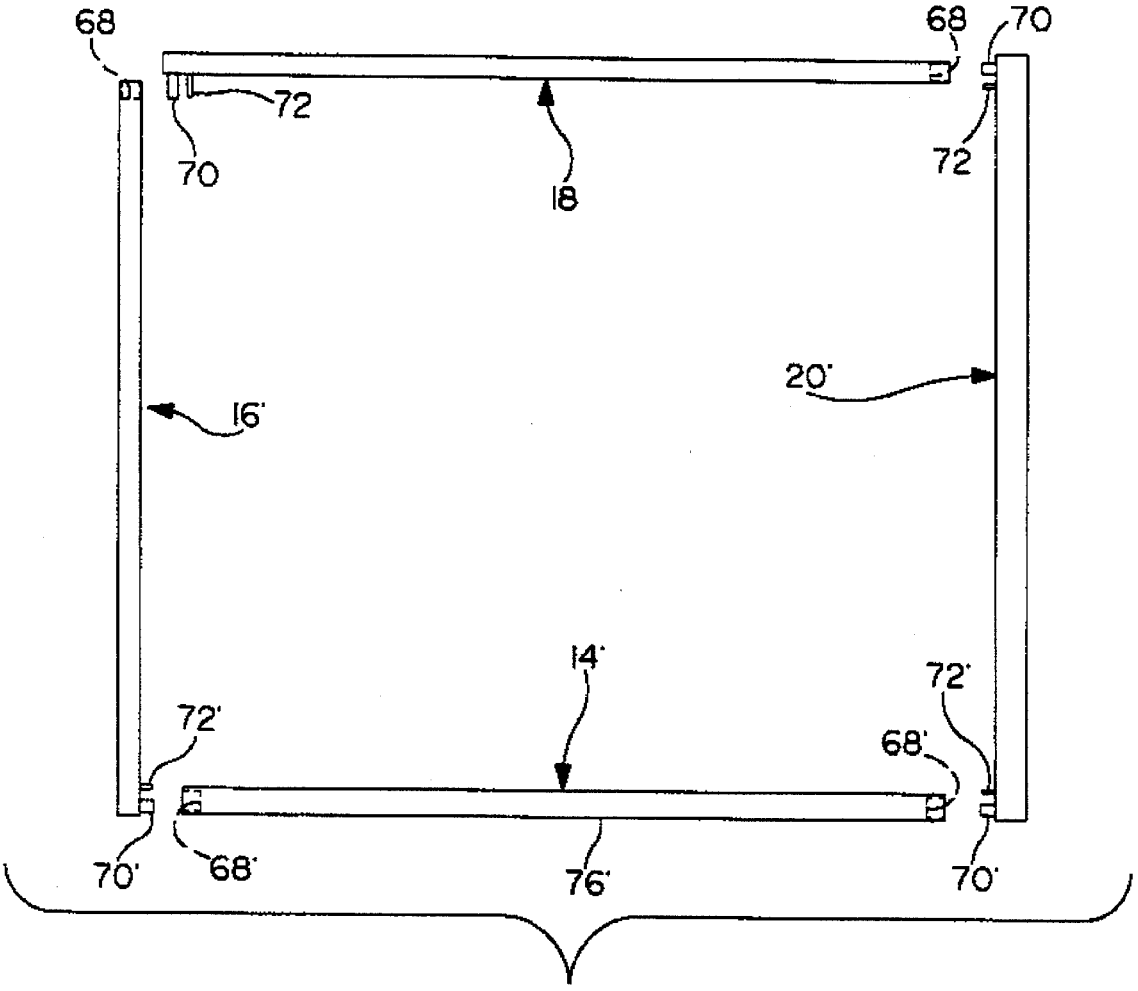
Figure 10:
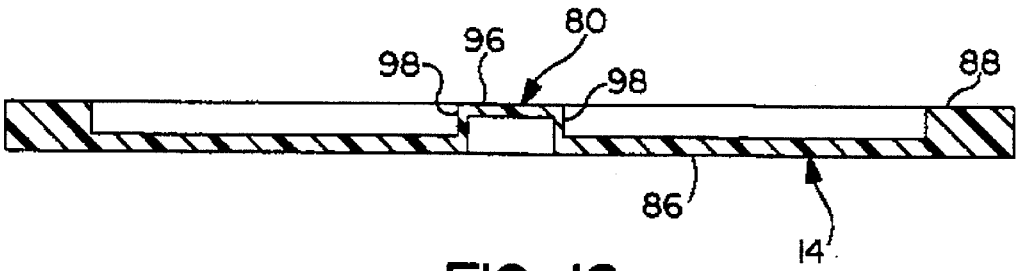

FIG. 9 is a top view of the side walls of another embodiment of the folding crate showing the interengaging elements on the side walls that help maintain the side walls in a vertical orientation; and FIG. 10 is a cross-sectional view along the section line 10—10 in FIG. 8 illustrating the protuberance that is formed in the side walls for allowing a stack of crates to be dragged along a floor with the aid of a hook.

DETAILED DESCRIPTION OF THE PREFERRED EMBODIMENTS

Figure 1:
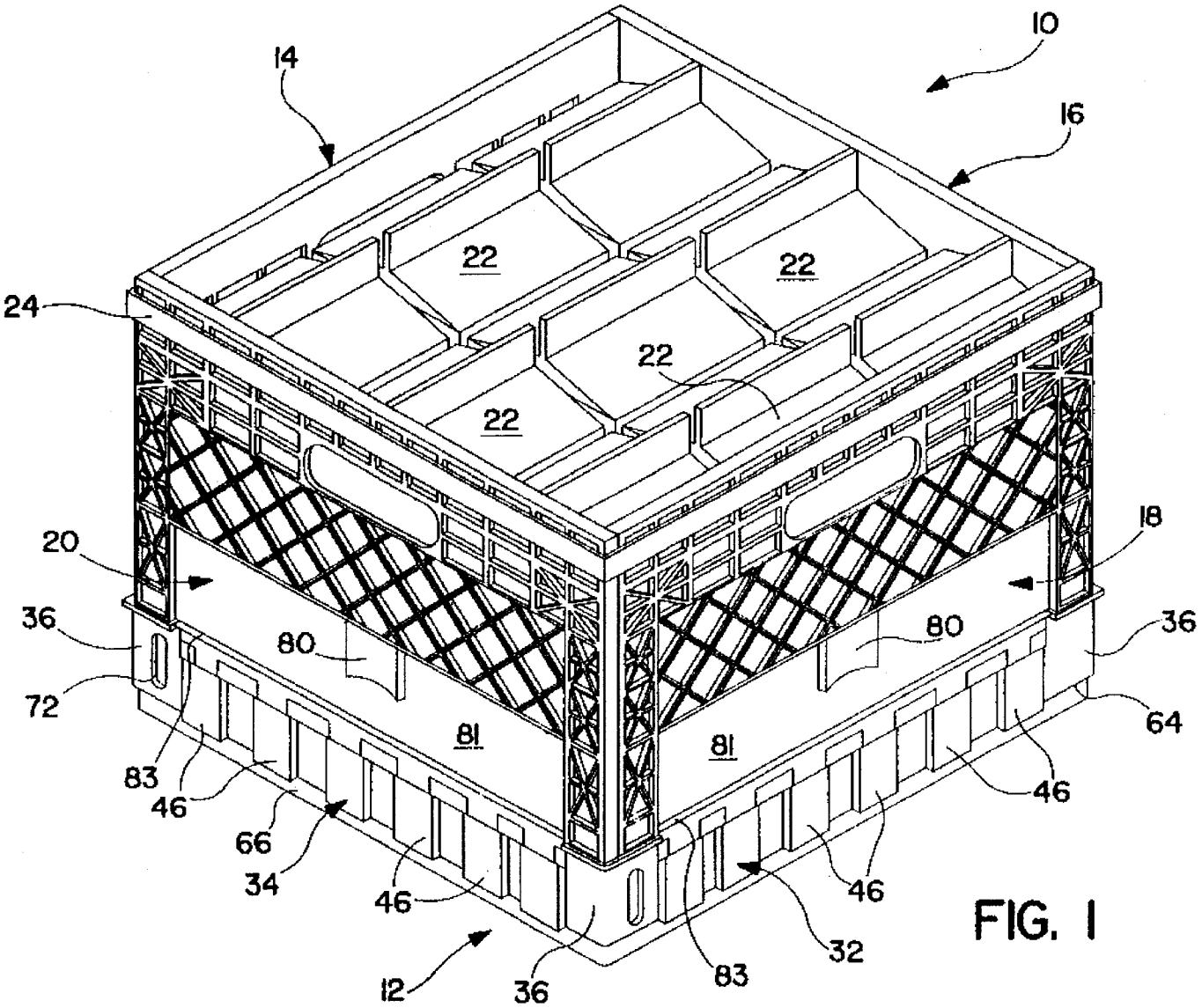
FIG. 1 is a top perspective view of the folding crate according to the present invention showing gable-top type packages in the crate.

With reference initially to FIG. 1, the crate 10 according to the present invention includes a four-sided base 12 and a plurality of side walls mounted on the base 12. The plurality of side walls include a first side wall 14, a second side wall 16, a third side wall 18 and a fourth side wall 20. The crate 10 is shown in FIG. 1 with the side walls 14, 16, 18, 20 in an upright vertical position for receiving packages such as gable-top type cartons 22. When the packages 22 have been placed in the crate, an encircling strap 24 is placed around the outer periphery of the side walls 14, 16, 18, 20 to impart rigidity to the crate 10 by tightly holding together the upstanding side walls 14, 16, 18, 20. The outwardly facing corners of the side walls 14, 16, 18, 20 can be provided with a recess or the like to receive and properly position the strap 24 around the side walls. Also, more than one strap can be utilized if desired. The strap 24 can consist of a length of plastic whose ends have been heat welded together.

As seen in FIG. 2, the base 12 is provided with a generally planar support surface 26 for supporting packages. The support surface 26 can be characterized by a waffle-type pattern of through openings. In that way, the overall weight of the crate 10 and the amount of material required to fabricate the crate 10 can be reduced.

The base 12 includes four upstanding sides 28, 30, 32, 34. The first side wall 14 is mounted on the first side 28 of the base 12, the second side wall 16 is mounted on the second side 30 of the base 12, the third side wall 18 is mounted on the third side of the base 12, and the fourth side wall 20 is mounted on the fourth side 34 of the base 12. Each comer of the base 12 is also provided with an upstanding supporting post 36 which, as will be described in more detail below, allows the crates to be stacked on top of one another when the side walls 14, 16, 18, 20 are folded inwardly. The tops of all of the supporting posts 36 are preferably coplanar to permit even stacking of the crates.

The base 12 is also provided with an arrangement for allowing each of the side walls 14, 16, 18, 20 to be hingedly mounted on the respective side of the base 12 so that the side walls 14, 16, 18, 20 can be moved from an upright substantially vertical position to an inwardly folded substantially horizontal position. That arrangement includes a hinge pin member 40 disposed on each side 28, 30, 32, 34 of the base 12. The hinge pin member 40 possesses a longitudinal axis that is parallel or substantially parallel to the plane of the support surface 26. In addition, the longitudinal axes of the hinge pin members 40 associated with each of the sides 28, 30, 32, 34 of the base 12 are located at different distances from the plane of the support surface 26. More particularly, the longitudinal axis of the hinge pin member 40 located along the first side 28 of the base 12 is located closest to the plane of the support surface 26 while the longitudinal axis of the hinge pin member 40 associated with the fourth side 34 of the base 12 is located farthest from the plane of the support surface 26. The longitudinal axis of the hinge pin member 40 associated with the second side 30 is located farther from the plane of the support surface 26 relative to the longitudinal axis of the hinge pin member 40 on the first side 28 of the base 12, Also, the longitudinal axis of the hinge pin member 40 associated with the third side 30 of the base 12 is located farther from the plane of the support surface 26 than the longitudinal axis of the hinge pin member 40 associated with the second side 32 of the base. Thus, as viewed in FIG. 2 and extending in a clockwise direction beginning with the first side 28, the longitudinal axis of the hinge pin member 40 associated with each successive side of the base is located at increasing vertical distances from the plane of the support surface 26.

Preferably, the longitudinal axis of the hinge member 40 associated with each side of the base 12 is spaced apart from the longitudinal axis of the hinge pin member 40 associated with the preceding side by a distance approximately equal to the thickness of the side walls. Such an arrangement allows the side walls 14, 16, 18, 20 which are mounted on the sides 28, 30, 32, 34 of the base 12 to be successively folded inwardly to a generally horizontal orientation.

Each of the hinge pin members 40 comprises a plurality of spaced apart hinge pin segments 42. Adjacent hinge pin segments 42 located along each side of the base 12 are spaced apart by upstanding side wall supports 44. The hinge pin segments 42 are formed integrally and in one piece with the side wall supports 44 as well as with the remainder of the base 12. That is, the hinge pin segments cannot be removed. As will be described in more detail below, the side wall supports 44 provide a support for the side walls 14, 16, 18, 20 when the side walls are in the upright vertical position. In addition, when the crates 10 are filled with packages and stacked on top of one another, the side wall supports 44 help transfer the load to the base 12.

A plurality of spaced apart reinforcing elements 46 can also be disposed along each side 28, 30, 32, 34 of the base 12. Each of the side walls supports 44 preferably extend between adjacent reinforcing elements 46 so that the load transmitted to the side wall supports 44 is transmitted to the reinforcing elements 46 and then to the base 12. As an alternative to the reinforcing elements 46, the portion of each side 28, 30, 32, 34 of the base 12 located below the side wall supports 44 can be fabricated to have a substantially constant thickness.

FIG. 8 illustrates the first side wall 14 as viewed from the side that faces outwardly when the side wall is mounted on the base 12. The features associated with the first side wall 14 are also characteristic of the other side walls 16, 18, 20, except that the height of each of the side walls (i.e., the distance between the top and bottom edges of the side walls) differs. As seen in FIG. 8, the side wall is generally rectangular in shape. The top portion 90 and vertical side portions 92 of the side walls are provided with a pattern of through holes defined by a criss-cross arrangement of reinforcing ribs. A series of recessed regions also defined by a criss-cross arrangement of reinforcing ribs is provided in the middle portion 94 of the side walls and a recessed area which is absent the reinforcing ribs is provided along the lower portion 81 of the side walls.

An opening 49 that serves as a handle for facilitating the lifting of the crate can be provided at the top region of the side wall 14. A plurality of spaced apart knuckles or lugs 48 extend from the bottom edge of the side wall 14 for allowing the side wall 14 to be mounted on the respective side of the base. Located between adjacent knuckles 48 at the bottom edge of the side wall are a plurality of spaced apart support surfaces 58.

Figure 4:
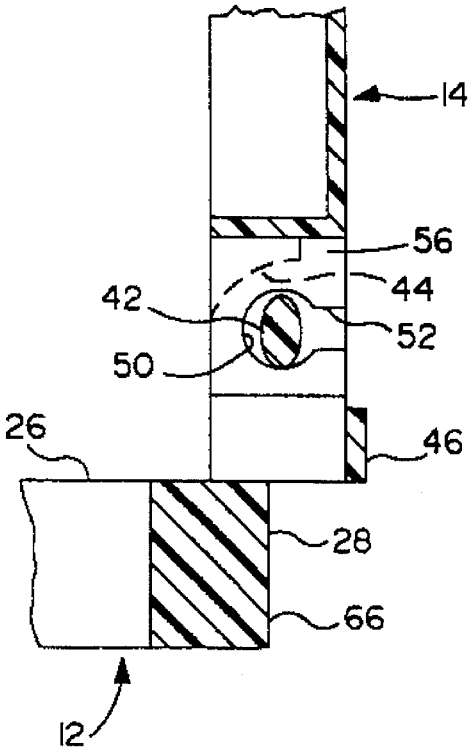
FIG. 4 is a cross-sectional view through the base and a portion of the side wall of the crate illustrating the hinge arrangement that allows the side walls to be folded inwardly.
Figure 5:
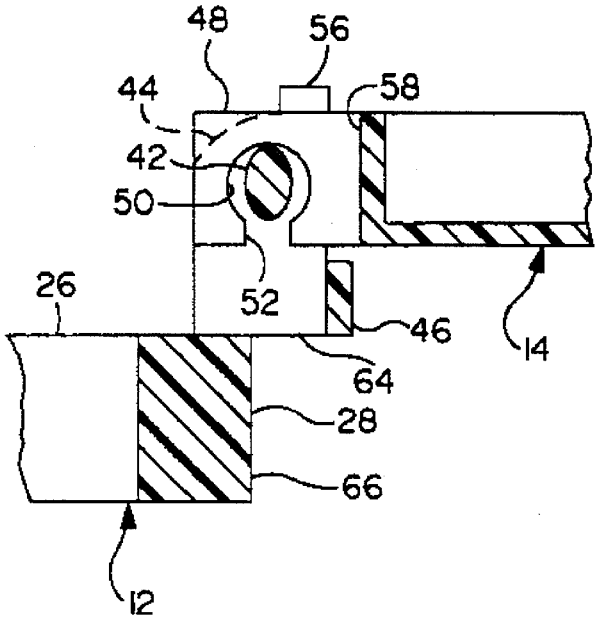
FIG. 5 is a cross-sectional view similar to FIG. 4 illustrating the way in which the side wall is mounted on the base.

FIGS. 4 and 5 illustrate cross sections through the first side 28 of the base 12 when the first side wall 14 is mounted on the base 12. It is to be understood, however, that the features depicted in FIGS. 4 and 5 are also characteristic of the way in which the other side walls 16, 18, 20 are mounted on their respective sides 30, 32, 34 of the base 12. As seen in FIG. 4, each of the knuckles 48 disposed along the bottom edge of the side wall 14 is provided with a generally circularly shaped through hole 50 which freely receives one of the hinge segments 42 disposed along the first side 28 of the base 12. The wall of each knuckle 48 is also provided with a slotted opening 52 that communicates with the through hole 50.

As can be seen from FIGS. 4 and 5, the hinge segment 42 which is loosely received in the hole 50 of the knuckle 48 possesses an oval or elliptical cross-sectional shape. All of the hinge segments 42 disposed along the four sides 28, 30, 32, 34 of the base possess the same oval or elliptical cross-sectional shape. The major axis of the elliptical or oval cross-section is oriented perpendicular or substantially perpendicular to the plane of the support surface 26 while the minor axis is oriented parallel or substantially parallel to the plane of the support surface 26. Thus, the smallest dimension of the elliptical cross-section is directed along a line passing through the center of the cross-section and parallel or substantially parallel to the plane of the support surface 26. The greatest dimension of the hinge segment cross-section is located along a line passing through the center of the cross-section and oriented perpendicular or substantially perpendicular to the plane of the support surface 26.

The width across the slotted opening 52 is specifically selected to be less than the largest dimension of the hinge pin segment cross-section (i.e., the distance along the major axis). On the other hand, the width across the slotted opening 52 is preferably equal to or substantially equal to the smallest dimension of the hinge pin segment cross-section (i.e., the distance along the minor axis).

The hinge arrangement shown FIGS. 4 and 5 allows the side walls 14 to be easily mounted on the respective side 28 of the base 12 and yet prevents the side wall 14 from being disengaged from the base when the side wall is in the upright vertical position. That is, with the side wall located in a horizontal position and positioned outwardly with respect to the support surface 26 as shown in FIG. 5, the slotted opening 52 in each of the knuckles 48 is oriented downwardly. Since the width across the slotted opening 52 is substantially the same as the narrowest dimension of the hinge pin segment cross-section, the hinge pin segment 42 easily passes through the slotted opening 52 when the side wall is mounted on the base 12. It is, of course, to be understood that the width across the slotted opening 52 can be slightly smaller or larger than the narrowest dimension across the hinge pin segment cross-section depending upon, for example, the pliability of the plastic material from which the side wall 14 is fabricated.

Once the side wall 14 is mounted on the base 12 in the manner shown in FIG. 5, the side wall 14 can be pivoted upwardly to the vertical upright position shown in FIG. 4. When positioned in the upright vertical position shown in FIG. 4, the slotted opening 52 faces outwardly and the orientation of the slotted opening 52 relative to the elliptical cross-section of the hinge pin segment 42 inhibits or prevents the side wall 14 from being readily removed from the side of the base 12. Thus, the side wall 14 can be easily mounted on the base 12, but is not susceptible to inadvertent removal during use of the crate.

FIGS. 4 and 5 also illustrate an upstanding support ledge 56 that is disposed at the top end of each of the side wall supports 44. As can be seen in FIG. 4, when the side wall 14 is in the vertical upright position, and particularly when a load is applied through the side wall 14 (such as would occur when the crates are stacked on top of one another), the side wall 14 rests upon the support ledge 56. Preferably, a small amount of play is provided between the hinge pin segment 42 and the through hole 50 in the knuckle so that when the side wall 14 is in the vertical upright position, the support surfaces 58 at the bottom edge of the side wall bear directly against the support ledge 56 of the base 12. Thus, the hinge pin segments 42 will not be subjected to the full loading force transmitted through the side wall 14. Rather, loads transmitted through the side wall 14 will be transferred to the base 12 by way of the side wall supports 44 and the reinforcing elements 46. In that way, potential damage to the hinge pin segments 42 can be avoided.

In addition, by providing play between the hinge pin segments 42 and the through openings 50 in the knuckles 48, the support surfaces 58 at the bottom edge 58 of the side wall 14 will be able to clear the top surface of the support ledge 56 when the side wall 14 is pivoted from the horizontal position shown in FIG. 5 to the vertical upright position shown in FIG. 4. Once the side wall 14 has been mounted on the respective side 28 of the base 12 and has been moved to the upright vertical position shown in FIG. 4, the support ledge 56 prevents the side wall 14 from inadvertently pivoting outwardly. Through the application of a force sufficient to overcome the interference between the support surface 58 and the support ledge 56, the side wall 14 can be pivoted outwardly once again to the position shown in FIG. 5. In that position, the side wall 14 can be removed from the base 12 if desired.

As an alternative to the arrangement shown in FIGS. 4 and 5, the side walls could be designed in a manner that would permit them to be mounted on the respective sides of the base 12 when the side walls are horizontally positioned in overlying relation to the support surface 26. In such an alternative arrangement, the slotted openings 52 in the knuckles 48 would face downwardly when the side walls are mounted on the hinge pin members 40 and would face inwardly when the side walls are in the upright vertical position.

The crate 10 according to the present invention as shown in FIG. 1 is designed so that the first side wall to fold inwardly is the first side wall 14, the next side wall to fold inwardly is the second side wall 16, the third side wall to fold inwardly is the third side wall 18 and the final side wall to fold inwardly is the fourth side wall 20. Thus, as can be seen in FIG. 1, when the side walls 14, 16, 18, 20 are in the upright vertical position, both vertical sides of the first side wall 14 are positioned between the inwardly facing inner surfaces of the second and fourth side walls 16, 20, one side of the second side wall 16 faces the inwardly facing inner surface of the third side wall 18 while the opposite side of the second side wall 16 is exposed, one vertical side of the third side wall 18 faces the inwardly facing inner surface of the fourth side wall 20 while the opposite vertical side of the third side wall 18 is exposed, and both vertical sides of the fourth side wall 20 are exposed.

The side walls 14, 16, 18, 20 are also provided with an arrangement for providing interengagement between adjacent side walls. With reference to FIG. 3, the inwardly facing inner surfaces of certain side walls have projections 70 extending therefrom for engaging blind holes 68 that are provided on the sides of mating side walls. The blind holes 68 are completely surrounded on all sides by portions of the respective side walls. The interengagement between the projections 70 and the blind holes 68 helps properly orient the side walls 14, 16, 18, 20 in a vertical orientation so that the strap 24 can be placed around the outer periphery of the side walls. More than one projection 70 and blind hole 68 can be provided on each of the respective sides and inner surfaces of the side walls if desired. In addition, longitudinally extending projecting elements 72 can be provided adjacent the projections 70 for engaging the inwardly facing inner surfaces of the respective side walls to help further maintain the vertical orientation of the side walls. The projecting elements 72 can extend longitudinally along the inner surfaces of the respective side walls for a predetermined distance.

After the packages 22 have been removed from the crate 10, the strap 24 can be removed to permit the inward folding of the side walls 14, 16, 18, 20. As noted above, the crate is designed so that the first side wall 14 is the initial side wall to be folded inwardly. The crate is also preferably designed so that the first side wall 14 automatically falls inwardly upon removal of the strap 24. To achieve this result, the first side wall 14 is constructed so that when it is in the upright vertical position, its center of gravity is located inwardly with respect to the longitudinal axis of the hinge pin member 40 located along the first side 28 of the base 12. Once the strap 24 has been removed, the projections 70 and the blind holes 68 tend to disengage from one another and the first side wall 14 automatically falls inwardly due to the fact that its center of gravity is located inwardly of the longitudinal axis of the associated hinge pin member 40. In addition, the other side walls 16, 18, 20 are preferably designed so that their respective centers of gravity are located outwardly with respect to the longitudinal axis of the hinge pin member on which they are respectively mounted. Once the first side wall 14 has fallen inwardly, the second, third and fourth side walls can be easily pushed inwardly in that order. Thus, the crate according to the present invention automatically identifies the first side wall that is to be folded inwardly.

A crate which is designed so that the first wall tends to automatically fall inwardly upon the removal of the packages 22 and the strap 24 requires a two step operation in order to fold the sides of the crate. That is, the strap 24 must first be removed which typically requires that the strap 24 be cut or otherwise designed so that its ends can be separated. Once the strap 24 has been severed, the side walls must then be folded inwardly. As an alternative, the crate can be designed to facilitate a single step operation. FIG. 9 illustrates an arrangement of interengaging features for the side walls 14, 16, 18, 20 that permits such a single step operation.

As seen in FIG. 9, the third side wall 18 is the same as the third side wall 18 shown in FIG. 3. In addition, the side of the second side wall 16' and the side of the fourth side wall 20' which are located closest to the third side wall 18 are the same as in the FIG. 3 embodiment (i.e., a blind hole 68 is provided in the side of the second side wall 16' while a projection 70 and a projecting element 72 are provided on the inwardly facing inner surface of the fourth side wall 20'). The difference lies in the first side wall 14' and the sides of the second and fourth side walls 16', 20' which are located closest to the first side wall 14'. In particular, both sides of the first side wall 14' are provided with a recess 68' that opens to the outer rear surface 76' (i.e., the surface of the first side wall 14' which faces outwardly when the first side wall 14' is positioned in the upright vertical position). The recesses 68' are adapted to receive the projections 70' extending from the sides of the second and fourth side walls 16', 20'. Also, projecting elements 72' are provided adjacent the projections 70'. However, the projections 70' and the projecting elements 72' extend inwardly away from the inner surfaces of the respective side walls 16', 20' to a smaller extent than the other projections 70 and projecting elements 72.

With the side walls designed in the manner shown in FIG. 9, the side walls can be folded inwardly without the need for cutting the strap 24 or otherwise separating the ends of the strap 24. By simply pulling the first side wall 14' inwardly with a relatively small force, the folding process of the side walls can be initiated. Since the recesses 68' which receive the projections 70' open to the outer rear surface of the first side wall 14', the second and fourth side walls 16', 20' need not be pulled apart in order to initiate the inward folding of the first side wall 14'. Further, since the projecting elements 72' do not extend inwardly to such a great extent, it is possible with the application of a relatively small force to pull the first side wall 14' past the projecting elements 72'.

Once the first side wall 14' has been folded inwardly, sufficient slack is produced in the strap 24 so that the remaining side walls 16', 18, 20' can also be folded inwardly. Consequently, the strap 24 can be removed without being cut or separated. A suitable visual indicator can also be provided on the first side wall 14' to identify it as the first side wall to be folded inwardly.

As illustrated in FIG. 1, the top ends of each of the side walls 14, 16, 18, 20 are located at the same height. On the other hand, as noted above and as illustrated in FIG. 2, the longitudinal axes of the hinge pin members 40 located along each side of the base 12 are vertically spaced from the plane of the support surface 26 by different distances. Thus, each of the side walls 14, 16, 18, 20 possesses a different vertical height. In particular, the first side wall 14 possesses the greatest height, the second side wall 16 is slightly shorter in height than the first side wall 14, the third side wall 18 is slightly shorter in height than the second side wall 16 and the fourth side wall 20 possesses the smallest height.

As can be seen in FIGS. 1 and 2, the underside of the base 12 is provided with an inset shoulder 64 that extends around the entire periphery of the base 12 so as to define a lower base portion 66 (see also FIGS. 4 and 5). The outer circumference of the lower base portion 66 is smaller than the outer circumference of the portion of the base located above the inset shoulder 64. The inset shoulder 64 allows the crates 12 to be stacked on top of one another when the side walls 14, 16, 18, 20 are in the vertical upright position as shown in FIG. 1 and when the side walls 14, 16, 18, 20 are folded inwardly.

Figure 7:
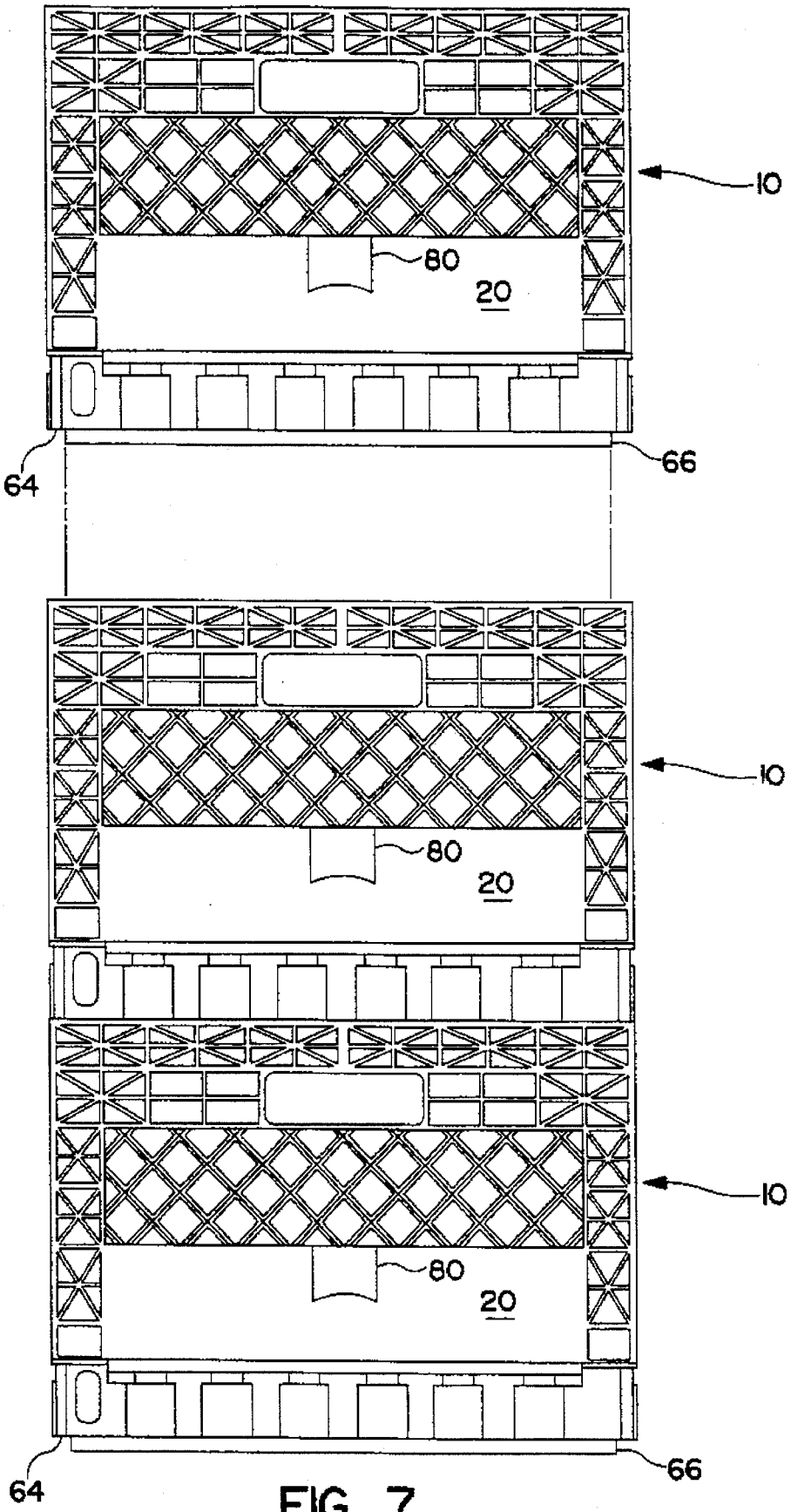
FIG. 7 is another side view showing how the crates stack on top of one another when the side walls are in the upright vertical position.

When the side walls 14, 16, 18, 20 are in the upright vertical position, the crates 10 are stacked on top of one another in the manner shown in FIG. 7. In particular, the outer circumference of the lower base portion 66 is substantially equal to or slightly less than the inner circumference defined by the inner surfaces of the upstanding side walls 14, 16, 18, 20. Thus, when the crates 10 are stacked on top of one another, the inset shoulder 64 of the base 12 rests upon the top surfaces of the vertical upright side walls 14, 16, 18, 20 while the lower base portion 66 fits inside the vertical upright side walls 14, 16, 18, 20.

Figure 6:
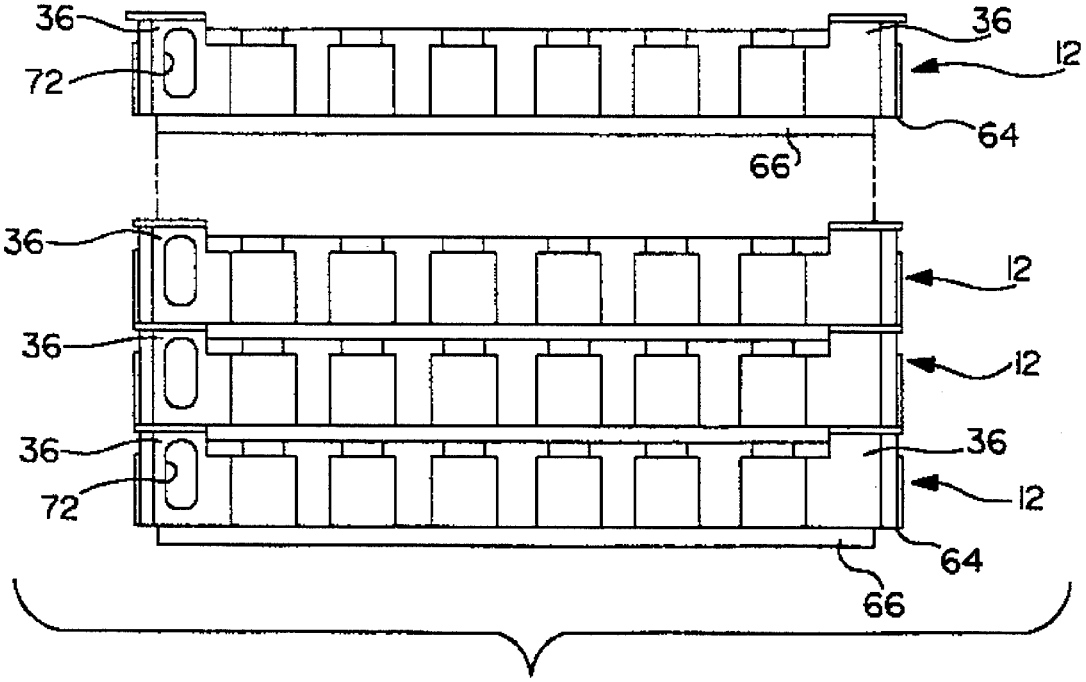
FIG. 6 is a side view showing how the crates stack on top of one another when the side walls of the crates are folded inwardly.

When the side walls 14, 16, 18, 20 are folded inwardly, the crates 10 are stacked on top of one another in the manner shown in FIG. 6. The outer circumference of the lower base portion 66 is substantially equal to or slightly less than the inner circumference defined by the upstanding supporting posts 36 located at each comer of the base 12. Thus, when the folded crates 10 are stacked on top of one another, the inset shoulder 64 of the base 12 rests upon the top surfaces of the upstanding supporting posts 36 while the lower base portion 66 fits inside the supporting posts 36.

The sides 28, 30, 32, 34 of the base 12 possess the same length so that the base 12 forms a square. In addition, each of the side walls 14, 16, 18, 20 possesses the same width. Thus, the crates can be stacked on top of one another regardless of the orientation of each overlying crate. That is, when the crates are in the folded condition shown in FIG. 6, the crates can be stacked so that, for example, the first side 28 of the base 12 of one crate overlies the second side 30 of the base 12 of the underlying crate. Likewise, when the crates are filled with packages 22 and the side walls are in the upright vertical position as shown in FIG. 7, the crates can be stacked on top of one another such that, for example, the first side wall 14 of one crate overlies and is aligned with the second side wall 16 of the underlying crate. Hence, in both the unfolded condition and the folded condition, the crates can be stacked on top of one another without having to orient each crate in a particular manner with respect to the underlying crate.

When the crates are in the stacked conditions shown in FIGS. 6 and 7, it is oftentimes desirable to move the crates as a stack across the floor. This can be accomplished by engaging the bottom most crate in the stack with a hook and dragging the stack of crates across the floor. To more easily allow the stack of crates to be grasped with a hook, at least one of the supporting posts 36 located at the corners of the base 12 is provided with a through opening 72 as seen in FIG. 6. The through opening 72 extends through the upstanding side wall of the supporting posts 36. Preferably, all of the supporting posts 36 are provided with such through openings 72 so that the bottom most crate can be grasped with a hook regardless of the orientation of the bottom most crate. The through hole 72 is preferably used to move a stack of crates when the side walls 14, 16, 18, 20 of the crates are folded inwardly as shown in FIG. 6.

When the crates are filled with packages and stacked, a different mechanism is preferably utilized for grasping the bottom most crate with a hook. As seen in FIG. 8, for example, the recessed lower area 81 on at least one of the side walls 14 is provided with a protuberance or channel 80 that extends outwardly with respect to the surrounding portions of the recessed area 81. The protuberance or channel 80 extends along only a portion of the height of the recessed lower area 81 so that the lower end 82 of the protuberance is spaced from the shoulder 83 that extends along the bottom portion of the side wall 14. The protuberance 80 is hollow and opens at the lower end 82 for receiving the hook.

As seen in FIG. 10, the protuberance or channel 80 is defined by an outdented region that is formed in the side wall 14. The protuberance or channel 80 defined by the outdented region includes side walls 98 and a front wall 96 that is coplanar or substantially coplanar with the outwardly facing outer surface 88 of the portions of the side wall 14 surrounding the recessed lower region 81. The top of the protuberance 80 abuts the underside of the middle region 94 and the hollow interior of the protuberance 80 opens to the inner surface 86 of the side wall 14.

In the illustrated embodiment, the protuberance or channel 80 is centered in the widthwise direction of the side wall 14 so that the force applied to the stack of crates through use of the hook is centered. However, the protuberance 80 could be located at other positions along the widthwise direction of the side wall 14. Preferably, the protuberance or channel 80 is provided on each of the side walls so that the bottom most crate can be grasped with a hook regardless of the orientation of the bottom most crate.

The base 12 and the side walls of the crate 10 are preferably made of a plastic material, particularly a plastic material which possesses good cold weather characteristics as well as shock and impact resistant properties. Examples of these materials are polypropylene and high density polyethylene (HDPE), the latter being particularly desirable as it is well suited for resisting impacts and shocks.

While this invention has been illustrated and described in accordance with the preferred embodiment, it is recognized that variations and changes may be made, and equivalents employed herein without departing from the spirit of the invention as set forth in the claims.

What is claimed is:

1. A folding crate for holding packages, comprising:

a base having a substantially planar support surface lying in a plane for supporting packages, said base having four sides and a hinge pin member disposed at each side, each hinge pin member having a longitudinal axis that is vertically spaced from the plane of the support surface, each hinge pin member being oval in cross-section and having a smallest dimension as measured along a first line that is substantially parallel to the plane of the support surface and a largest dimension as measured along a second line transverse to said first line; and four side walls which are each located along one of the sides of the base, each side wall having an inner surface that faces inwardly when the side walls are in an upright vertical position and an oppositely positioned outer surface that faces outwardly when the side walls are in the vertical upright position, each side wall having at least one knuckle extending from a lower end thereof, the at least one knuckle on each side wall having a substantially circular through hole which freely receives the hinge pin member so that the side wall can be pivoted from an upright substantially vertical position to an inwardly folded position, said at least one knuckle having a slotted opening which extends through a wall of the knuckle and into the through hole for allowing the side wall to be mounted on the respective hinge pin member, said slotted opening having a width that is less than said largest dimension of the hinge pin cross-section, at least one of said side walls being provided with a protuberance on the outer surface that extends outwardly away from surrounding areas of the side wall, said protuberance being hollow and having an open lower end for receiving a tool for use in moving the crate and a plurality of other crates stacked thereon.

2. The folding crate according to claim 1, wherein said hinge pin member includes a plurality of hinge pin segments disposed along each side of the base, said hinge pin segments being integrally formed in one piece with the base and being spaced apart from one another by side wall supports, and including a plurality of knuckles extending from the lower end of each side wall, each knuckle having a substantially circular through hole which loosely receives one of the hinge pin segments.

3. The folding crate according to claim 1, wherein the longitudinal axis of the hinge pin member located at each side of the base is positioned at a different vertical distance from the plane of the support surface, the longitudinal axis of the hinge pin member located at one side of the base having being positioned closest to the plane of the support surface and the longitudinal axis of the hinge pin member located at a side of the base adjacent said one side being located furthest away from the plane of the support member.

4. The folding crate according to claim 3, wherein said base includes four comers and an upstanding supporting post located at each comer for receiving and locating another crate in a stacked relationship, each supporting post being provided with a hole that extends through an upstanding wall of the supporting post.

5. The folding crate according to claim 4, wherein said base has an underside that is provided with an inset shoulder extending around a periphery of the underside of the base for allowing the crate to be stacked on another crate with the side walls in either the upright substantially vertical position or the inwardly folded position, each side of said base having the same length.

6. The folding crate according to claim 1, wherein each side wall is adapted to be mounted on the respective hinge pin member when the side wall is positioned outwardly with respect to the base, said slotted opening in the at least one knuckle of each side wall facing downwardly when the side wall is positioned outwardly and said slotted opening in the at least one knuckle of each side wall facing outwardly when the sidewall is positioned in the upright substantially vertical position.

7. A folding crate for holding packages, comprising:

a base having a substantially planar support surface lying in a plane for supporting packages, said base having a plurality of sides which are each provided with a hinge pin member, each hinge pin member possessing a cross-sectional shape in which a first dimension of the cross-sectional shape along a line passing through a center of the cross-sectional shape and extending substantially perpendicular to the plane of the support surface is greater than a second dimension of the cross-sectioned shape along a line passing through a center of the cross-sectional shape and extending substantially parallel to the plane of the support surface; and a plurality of side walls which are each provided with at least one knuckle at a bottom end, the at least one knuckle on each of the side walls being provided with a through hole in which is positioned one of the hinge pin members for allowing the side wall to be moved from an upright substantially vertical position to an inwardly folded position, the at least one knuckle on each side wall including a slotted opening that extends through a wall of the knuckle and into the through hole to allow the side wall to be mounted on the hinge pin member, said slotted opening having a width that is less than the first dimension of the cross-sectional shape of the hinge pin member.

8. A folding crate according to claim 7, wherein the hinge pin member located at each side of the base includes a plurality of spaced apart hinge pin segments that are integrally formed in one piece with the base.

9. The folding crate according to claim 8, wherein the hinge pin segments on a side of the base are coaxially disposed along a longitudinal axis, the hinge pin segments on each side of the base being separated by upstanding side wall supports upon which the respective side wall rests when the side wall is in the upright substantially vertical position.

10. The folding crate according the claim 9, wherein said plurality of side walls includes four side walls, each side wall including a plurality of knuckles extending from the bottom end, each knuckle having a through hole in which is positioned one of the hinge pin segments and a slotted opening which opens into the through hole, the slotted opening in the knuckles of each side wall facing outwardly when the side wall is in the upright substantially vertical position.

11. The folding crate according to claim 10, wherein said four side walls include a first side wall, a second side wall, a third side wall positioned opposite said first sidewall, and a fourth side wall positioned opposite said second side wall, said second and fourth side walls having inwardly facing inner surfaces that face one another when the side walls are positioned upright, said first side wall being positioned between the inner surfaces of the second and fourth side walls when the side walls are in the upright substantially vertical position.

12. The folding crate according to claim 7, wherein the hinge pin members possess an elliptical cross-sectional shape having a major axis that is disposed substantially perpendicular to the plane of the support surface and a minor axis that is disposed substantially parallel to the plane of the support surface.

13. A folding crate for holding packages, comprising:

a base having a substantially planar support surface lying in a plane for supporting packages, said base having a plurality of sides which are each provided with a hinge pin member, the hinge pin member on each side having a longitudinal axis which is vertically spaced above the plane of the support surface, the longitudinal axis of each hinge pin member being vertically spaced from the plane of the support surface by a different distance; and a plurality of side walls which are each provided with at least one knuckle at a bottom end for mounting the side wall on a respective one of the hinge pin members, each hinge pin member being received in a through hole provided in the at least one knuckle of the respective side wall so that each side wall can be moved from an upright substantially vertical position to an inwardly folded horizontal position, one of said side walls being constructed such that a center of gravity of the one side wall is located inwardly of the longitudinal axis of the respective hinge pin member when the one side wall is in the upright substantially vertical position.

14. A folding crate according to claim 13, wherein the one side wall is mounted on the hinge pin member whose longitudinal axis is located closest to the plane of the support surface.

15. The folding crate according to claim 13, wherein said one side wall comprises a first side wall, and said plurality of side walls includes a second side wall, a third side wall located opposite said first side wall and a fourth side wall located opposite said second side wall, said second and fourth side walls including inwardly facing inner surfaces that face one another when the side walls are in the vertical upright position, said first wall having sides that are positioned between the inwardly facing inner surfaces of the second and fourth side walls when the side walls are in the upright substantially vertical position, the second, third and fourth side walls possessing a center of gravity that is positioned outwardly with respect to the longitudinal axis of the respective hinge pin member when the second, third and fourth side walls are in the upright substantially vertical position.

16. The folding crate according to claim 15, and including a strap for tightly encircling an outer periphery of the side walls when the side walls are in the vertical upright position, each of said side walls being provided with means for engaging adjacent side walls to maintain the side walls in the upright substantially vertical position when the side walls are encircled by the strap.

17. A folding crate for holding packages, comprising:

a base having a substantially planar support surface lying in a plane for supporting packages and a plurality of sides, said base being configured to allow the crate to be stacked on top of another crate;

a plurality of side walls which are each mounted on one of the sides of the base, each side wall including an inwardly facing inner surface and an oppositely positioned outwardly facing outer surface, at least one of said side walls being provided with a protuberance on the outer surface that extends outwardly away from surrounding areas of the side wall, said protuberance having a front surface and side surfaces which define a hollow area, a lower end of said protuberance being open to the hollow area to allow a tool to be inserted through the open end and into the hollow area for use in moving the crate and a plurality of other crates stacked thereon.

18. The folding crate according to claim 17, including hinge means for mounting each side wall on the base so that the side walls can be pivoted from an upright substantially vertical position to an inwardly folded position, said base including four comers and an upstanding supporting post located at each comer for receiving and locating another crate in a stacked relationship, said base having an underside that is provided with an inset shoulder extending around a periphery of the underside of the base for allowing the crate to be stacked on another crate with the side walls in either the upright substantially vertical position or the inwardly folded position.

19. The folding crate according to claim 18, wherein said hinge means includes a plurality of spaced apart hinge segments disposed along each side of the base and a plurality of knuckles extending from a bottom end of each side wall, the knuckles on each side wall having a substantially circular through hole which freely receives one of the hinge pin segments, the knuckles on each side wall having a slotted opening which extends through a wall of the knuckle and communicates with the through hole for allowing the side wall to be mounted on the respective hinge pin segment, said hinge pin segments having an elliptical cross-section.

20. The folding crate according to claim 18, wherein each of said side walls includes a protuberance on the outer surface that extends outwardly away from surrounding areas of the side wall, each protuberance having a front surface and side surfaces which define a hollow area, a lower end of each protuberance being open to the hollow area to allow a tool to be inserted through the open end and into the hollow area, each of said supporting posts being provided with a through hole disposed in an upstanding wall of the supporting posts for allowing the crate and a plurality of other crates stacked thereon to be moved when the side walls are in the inwardly folded position.

21. A folding crate according to claim 13, wherein said one side wall comprises a first side wall, said plurality of side walls including a second side wall having a center of gravity located outwardly of the longitudinal axis of the respective hinge pin member when the second side wall is in the upright substantially vertical position.

* * * * *